US005559311A

United States Patent [19]

Gorbatoff

[11] Patent Number: 5,559,311

[45] Date of Patent: Sep. 24, 1996

[54] DUAL DETENT DOME SWITCH ASSEMBLY

[75] Inventor: Christopher J. Gorbatoff, Vienna, Ohio

[73] Assignee: General Motors Corporation, Detroit, Mich.

[21] Appl. No.: 364,377

[22] Filed: Dec. 27, 1994

[51] Int. Cl.[6] ..... H01H 1/14

[52] U.S. Cl. ..... 200/513; 200/1 B; 200/339

[58] Field of Search ..... 200/513, 1 B, 200/561, 339

[56] References Cited

U.S. PATENT DOCUMENTS

| | | | |
|---|---|---|---|
| 3,932,722 | 1/1976 | Obata et al. | 200/340 |
| 4,376,238 | 3/1983 | Martin | 200/513 |
| 4,518,833 | 5/1985 | Watkins | 200/5 A |
| 4,527,030 | 7/1985 | Oelsch | 200/306 |
| 4,604,509 | 8/1986 | Clancy et al. | 200/513 |
| 4,654,488 | 3/1987 | Westfall | 200/339 X |
| 5,412,165 | 5/1995 | Malone et al. | 200/339 X |
| 5,426,275 | 6/1995 | Maeda et al. | 200/339 X |

FOREIGN PATENT DOCUMENTS

| | | | |
|---|---|---|---|
| 3536539 | 4/1987 | Germany | 200/1 B |
| 6150775 | 5/1994 | Japan | 200/513 |

*Primary Examiner*—Renee S. Luebke

*Attorney, Agent, or Firm*—William A. Schuetz; Cary W. Brooks

[57] ABSTRACT

An electrical switch assembly has a resilient dual detent dome carrying concentric electrically conducting pellets which sequentially contact conductive ends of traces on a printed circuit board in response to partial and full depression of the dome. The dome is designed to provide a first tactile feel when the first pellet contacts the circuit board and then a snap action tactile feel when the second pellet engages the circuit board.

3 Claims, 4 Drawing Sheets

DUAL DETENT DOME SWITCH ASSEMBLY

The present invention relates to an electrical switch assembly and, more particularly, to an electrical switch assembly having a resilient dual detent dome carrying concentric electrically conducting elements which sequentially contact conductive traces on a printed circuit in response to partial and full depression of the dome.

BACKGROUND OF THE INVENTION

In certain automotive switch assembly applications, a dual detent or dual function switch is either necessary or desired. For example, in power window switches having an express up or down feature, a dual function switch assembly is required. In such switches, a partial movement of the switch actuator would engage electrical contacts for energizing an electric motor to operate the window regulator mechanism to move the window at a regular or slow speed either up or down. Full movement of the actuator would engage other contacts to energize the motor to operate the window at a high or express speed.

Switches for affecting such dual functions have heretofore been provided. One such type switch utilizes modules with some type of mechanical actuating device, such as metal spring contacts. The metal spring contacts make clicking sounds when actuated. This is not desirable when quiet operation is sought. These switches also have a relatively high number of parts and are expensive.

Another dual detent or dual function switch uses two separate, resilient domes carrying conductive pellets on their underside for engaging conductive traces when depressed to energize an electric motor. These domes are at different heights and are operated in sequence. This switch requires additional space to fit the two domes in the switch assembly and special rocker actuators.

SUMMARY OF THE PRESENT INVENTION

The present invention provides a new and improved switch assembly having a single, resilient dual detent dome carrying concentric, electrically conducting elements which function to sequentially contact conductive traces or contacts located therebeneath in response to partial and full depression of the dome. The single dome has a three way switching function. When not depressed the switch is off. When being depressed a first extent, it bridges contact between a circuit trace and a ground trace. When fully depressed, it also bridges contact with a second conductive trace and the same ground. The single dome has a force-displacement curve such that two distinct detent or tactile feels occur, which the switch operator can readily sense. The first such feel is a resistance feel when a first conducting element or pellet engages its associated contact traces and the second feel is an overcenter, snap action feel when a second conducting element is moved toward engagement with its associated conductive traces.

More specifically, the present invention provides a new and improved electric switch assembly which comprises a stationary support carrying a plurality of closely spaced contacts or ends of traces of a printed circuit, an elastomeric dome which is mounted on the stationary support or printed circuit which overlies the contacts or ends of the traces and an actuator for depressing the dome. The elastic dome has a resilient, annular outer wall of a given thickness, an annular ring integral with the side wall adjacent its upper end and which carries an electrically conductive element on its underside, a central button carrying an electrically conductive element on its underside and a deflectable annular web having an inner end integral with the button and an outer end integral with the ring. The outer end of the web is spaced a greater distance from the printed circuit than the inner end thereof when the dome is in its normal free state position. The pellet on the button is spaced from the printed circuit a lesser distance than the element on the ring. When the dome is depressed by the actuator, the side wall deflects outwardly to move the pellet on the button into engagement with associated contacts or ends of the circuit traces on the printed circuit. When engagement occurs the tactile feel is felt by the operator of the switch. Further depression of the dome causes the side wall and the web both to deflect and with the web moving from its free state position over dead center with a snap action feel to a position in which its outer end is spaced a lesser distance from the printed circuit than its inner end and until the conductive element is engaged with other associated contacts or ends of the circuit traces on the printed circuit.

The advantages of the novel dual detent dome switch of the present invention is that it provides a multi-function capability in a single dome of the switch with very little increase in size, mass or cost over that of single function domes. In addition, it provides a good tactile feedback to the operator for each of the detents and thus is ergonomically satisfactory. In addition, the dual detent dome switch assembly can be incorporated within the confines of a normal size rocker switch assembly, such as those commonly used in automotive applications.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
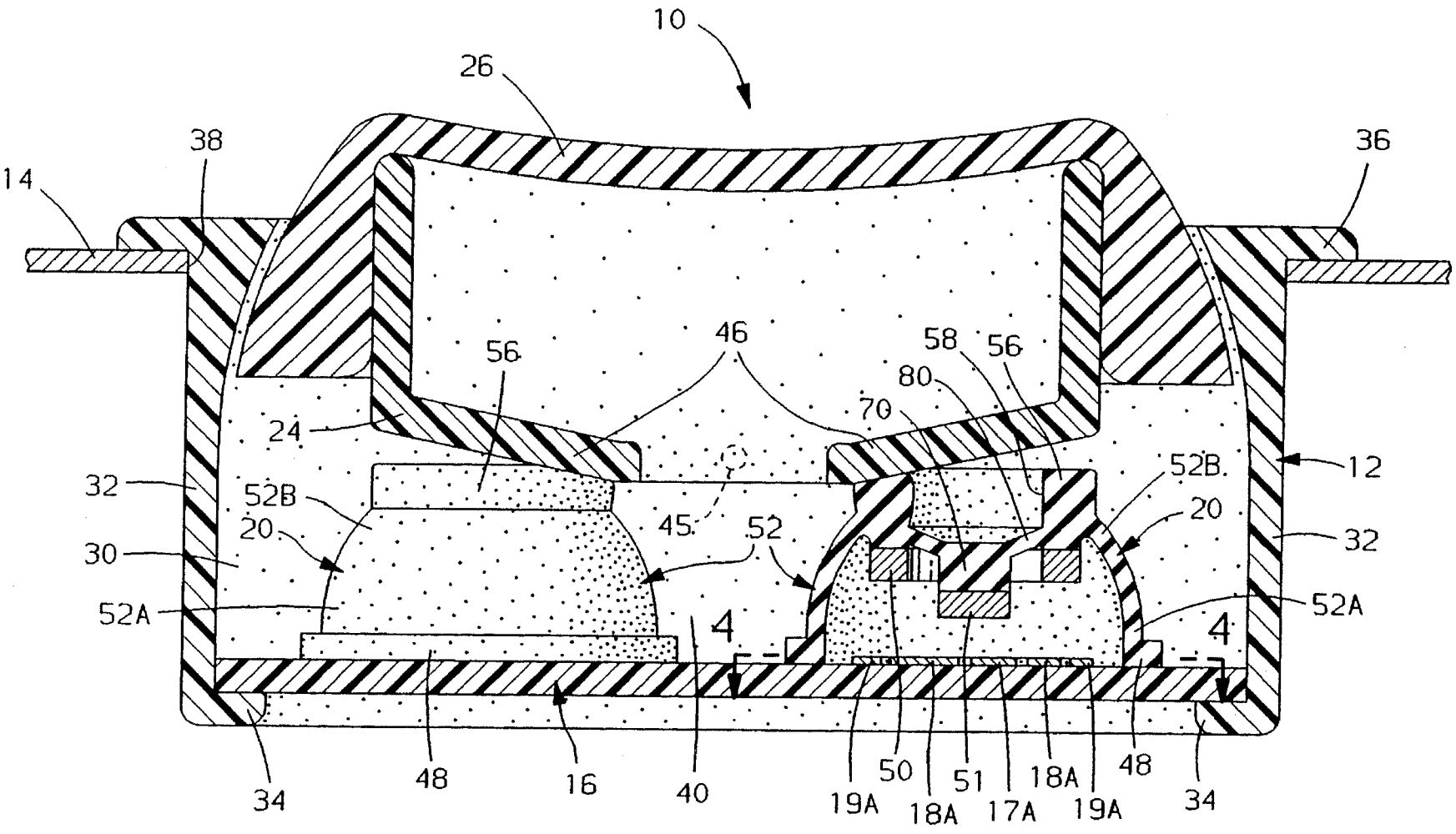
FIG. 1 is a longitudinal cross sectional view of the novel dual detent dome switch of the present invention and showing the same connected to a panel in an automotive vehicle.
Figure 2:
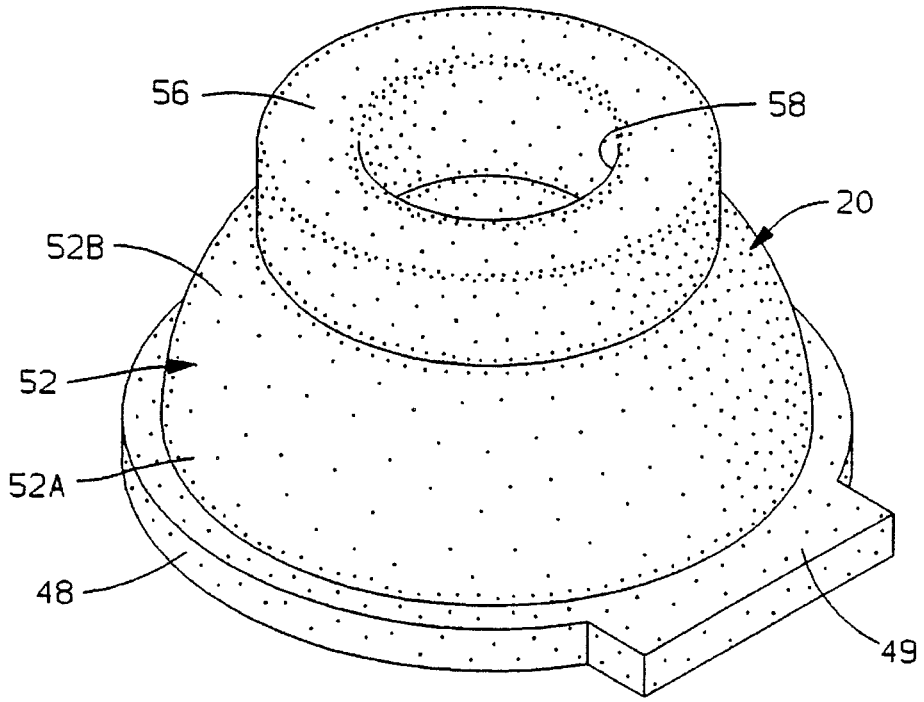
FIG. 2 is a top perspective view of the dome of the switch assembly shown in FIG. 1.
Figure 3:
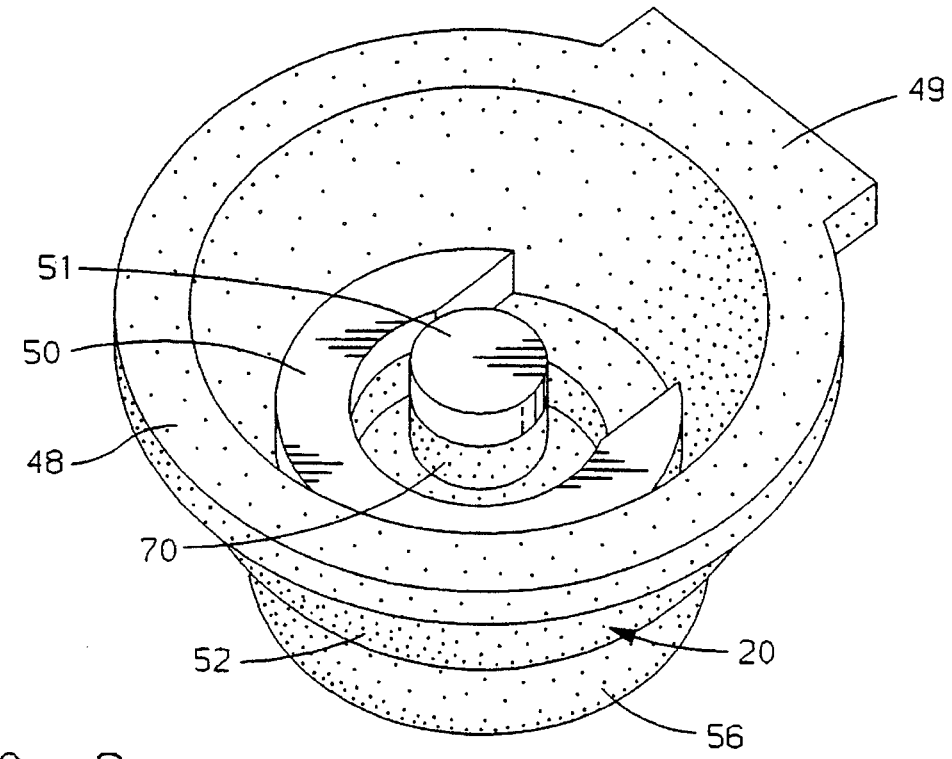
FIG. 3 is a bottom perspective view of the dome shown in FIG. 2.

Referring to FIG. 1 of the drawings, a novel electrical switch assembly 10 is thereshown. The switch assembly 10 comprises, in general, a housing 12 which is adapted to be supported on a support panel 14 in an automotive vehicle and which has a printed circuit means 16 at its bottom provided with a plurality of circuit traces thereon, such as circuit traces 17, 18 and 19 shown in FIG. 4, a pair of spaced elastomeric domes 20 whose bases are mounted on the printed circuit means 16 and which overlie ends of the circuit traces on the printed circuit means 16, a rocker actuator 24 for depressing the domes 20 and a key cap 26 overlying the rocker actuator 24.

The housing 12 comprises a one piece plastic member of a generally rectangular shape. The housing has a pair of elongated side walls 30 (only one of which is shown in FIG. 1) and a pair of end walls 32 whose lower ends terminate in generally horizontally extending ledges 34 for supporting the printed circuit means 16. The housing 12 at its upper end has an integral, generally horizontally extending escutcheon 36 which extends along both its sides and end walls 30, 32 and which overlies a rectangular opening 38 in the trim panel 14 of the automotive vehicle. The trim panel could either be a suitable side trim panel, dash panel or armrest of the automotive vehicle. The housing 12 along with the printed circuit means 16 defines a cavity 40.

The housing 12 is attached to the trim panel 14 by inserting the same through the openings 38 and suitably securing the same to the trim panel 14 in any suitable or conventional fashion, such as by deflectable latch fingers (not shown) formed integral with the housing 12.

The printed circuit means 16 is hereshown as comprising a rigid circuit board of generally rectangular shape having a plurality of circuit traces on its upper side, as will be hereafter more fully described. The circuit board 16 can be attached to the ledges 34 in any suitable or conventional manner. Alternately, the printed circuit could be a flexible printed circuit mounted onto a rigid panel.

Figure 4:
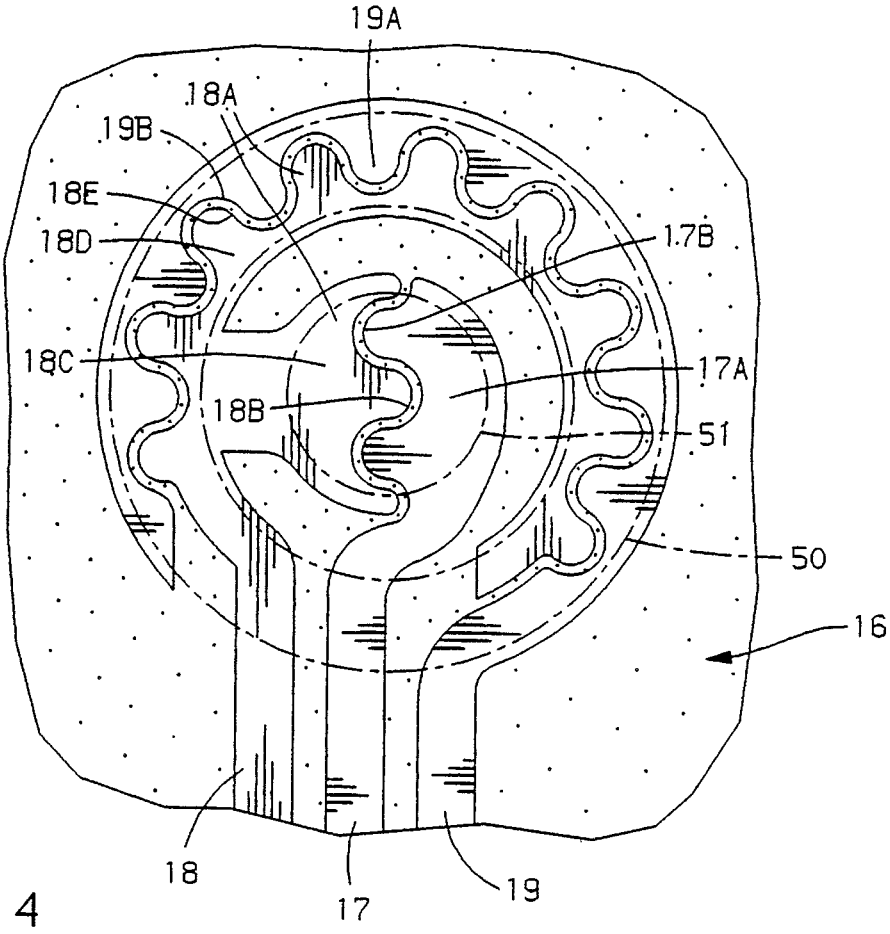
FIG. 4 is a fragmentary view of part of the switch assembly shown in FIG. 1 and looking in the direction of the arrows 4—4 of FIG. 1.

Since the printed traces for each of the domes 20 would be identical or substantially similar, only the printed circuit traces 17, 18 and 19 associated with the rightmost dome will be described in detail. As best shown in FIG. 4, the circuit traces 17, 18 and 19 are closely spaced together and terminate in ends 17A, 18A and 19A which are located inside the dome 20. The circuit traces 17, 19 are adapted to be connected to a power source and the circuit trace 18 is a common ground for each of the traces 17 and 19. The first circuit trace 17 at its end 17A is undulated as indicated by numeral 17B and interdigitated, but spaced from, with an interdigitated part 18B of the ground trace 18. The ground trace end 18A includes a first end portion 18C terminating in the undulations 18B and a second crescent shaped portion 18D which is spaced from, but surrounds a major portion of the inner ends 18C, 17A of the traces 18, 17, respectively. The ground trace portion 18D has an outer side which is undulated, as indicated by reference numeral 18E, and interdigitated with undulations 19B of the end 19A of the circuit trace 19. The end 19A of the trace 19 is also crescent shaped and shaped complementary to the crescent shaped portion 18D of the trace 18. As will be hereinafter more fully described, the ends 17A, 18A of the circuit traces 17, 18 are adapted to be bridged by a first electrically conductive pellet or element and the end portions 19A, 18A are adapted to be bridged by a second electrically conductive element or pellet.

The rocker actuator 24 comprises a hollow rectangular member made of a suitable plastic material and which is pivotally connected to each of the sides 30 of the housing via a pivot pin means 45. The rocker actuator has a pair of spaced bottom sides 46 which are beveled, as shown in FIG. 1, and which overlie the domes 20. Overlying the rocker actuator 24 is a rectangularly shaped, aesthetic key pad 26 which is suitably secured to the rocker actuator 24 and which is adapted to be manually depressed by an operator to depress the actuator 24 to operate one of the domes 20.

In accordance with the provisions of the present invention, a pair of novel domes 20 are provided. The domes 20 are adapted to be actuated by depressing the opposite ends of the rocker 24 via the key cap 26. Since both of the domes 20 are of an identical construction, only the rightmost dome, as viewed in FIG. 1, and the other drawings will be described in detail.

The dome 20 is made from a suitable, resilient silicone material and is annular or circular in shape. The dome 20 has an annular base 48 at its lower end, which is adapted to be suitably secured to the printed circuit board 16 in any suitable or conventional fashion, such as by adhesive means or by a fastener. The dome 20 overlies the ends 17A, 18A and 19A of the circuit traces 17, 18 and 19 and has an orientation feature in the form of a protrusion 49 on the base 48 to enable conductive elements 50 and 51 carried by the dome 20 to be properly orientated relative to the ends 17A, 18A and 19A of the circuit traces 17, 18 and 19. The dome 20 also has an annular, bell shaped outer side wall 52 whose lower end 52A is integral with the base 48 and whose upper end 52B is integral with an annular ring 56. The upper end 52B of the dome 52 is integral with the annular ring adjacent its lower end, as viewed in FIG. 1. The annular wall 52 is of a thickness such that it is readily resilient and deflectable. The annular ring defines a hollow central cavity 58 at its upper side and the annular ring carries a crescent shaped electrically conductive element or pellet 50 on its underside at a location just slightly below its integral connection with the side wall 52. The crescent shaped pellet 50 is shaped complementary to the crescent shaped end portion 18D and end 19A of the circuit traces 18 and 19, respectively, and is adhesively secured to the underside of the annular ring 56.

The dome 20 also includes a central button 70 having an underside 71 for carrying a circular shaped, electrically conductive element or pellet 51. The pellet 51 is adhesively secured to the underside of the button 70 and overlies the end portion 18C and end 17A of the circuit traces 18 and 17, respectively. The button 70 adjacent its upper end is integrally connected to the annular ring 56 adjacent its lower end by an annular web 80. The electrically conductive pellet 51 has a flat or planar undersurface and is spaced from the electrically conductive traces 17, 18 and 19 a lesser distance than the crescent shaped pellet 50 whose underside is also planar. The button 70 and the web 80 define the bottom of the cavity 58. It should also be pointed out that the radial thickness of the central button 70 and the radial thickness of the annular ring 56 are such that they do not deflect during normal actuation of the switch 10 and that they have a much greater thickness than the thickness of the annular web 80, which is deflectable during actuation of the switch 10 as will be hereinafter described.

Figure 5:
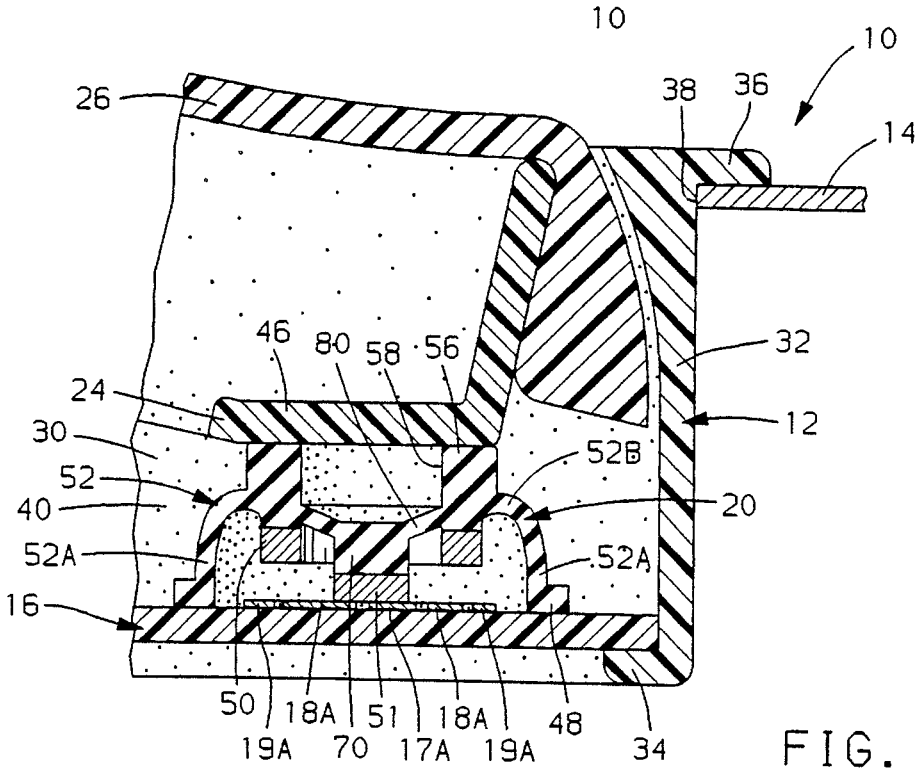
FIG. 5 is a partial cross sectional view of the switch shown in FIG. 1, but showing the dome in its first detented position.

In operation, when the operator depresses the switch key cap 26 and actuator 24 to depress the rightmost dome 20, the outer wall 52 thereof will be readily deflected outwardly until the pellet 51 carried by the central button 70 engages the ends 17A and 18C of the circuit traces 17 and 18, respectively, as shown in FIG. 5. Circuit traces 17, 18 would be connected to the low speed circuit of an electric motor, such as a window regulator motor, and would operate the window in a first or low speed up and down. When the conductive pellet engages the circuit traces 17, 18, a tactile feel is transmitted through the dome, rocker and key cap to the operator to indicate that he has engaged the circuit traces 17, 18 to energize the motor at a low speed. Further depression of the ring 56 of the dome 20 causes the outer wall 52 and the annular web 80 to be simultaneously deflected until the crescent shaped contact pellet 50 is in engagement with the contact end 19A and contact end portion 18D of the circuit traces 18, 19 as shown in FIG. 6, to complete a second circuit for the electric motor means to operate it at a high speed to cause the window to be moved in an express mode.

Figure 6:
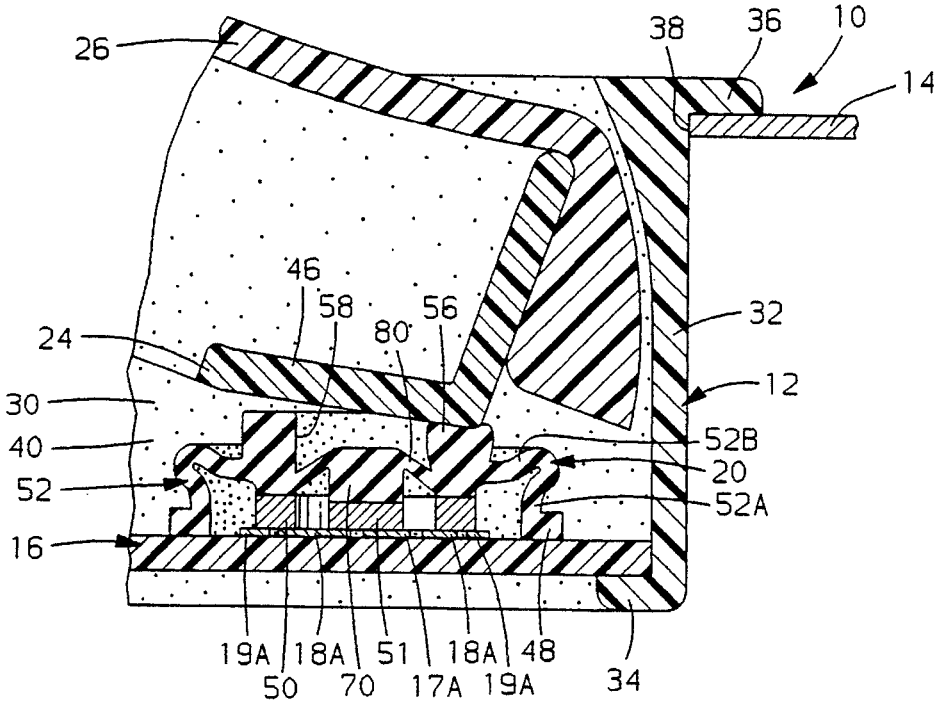
FIG. 6 is a fragmentary perspective view like that shown in FIG. 5, but showing the dome in its second detented position.

It should be noted that movement of the ring 56 of the dome 20 from its position shown in FIG. 5 in which only the central pellet 51 engages the circuit traces 17, 18, to its position shown in FIG. 6, causes the annular web 80 to be moved over dead center. As shown in FIG. 5, the end of the web 80 connected to the button 70 is spaced a distance from the printed circuit means which is less than the end of the web 80 which is integrally connected to the annular ring 56. Thus, when the ring 56 is further depressed from its position shown in FIG. 5 to its position shown in FIG. 6, the web 80 is deflected to a position in which its connection with the ring 56 is lower than its connection with the button 70. The web 80 causes the annular wall 52 to be further deflected radially outwardly until the web 80 is parallel to the circuit board 16, which is a dead center position. Further movement causes the annular wall 52 to rapidly deflect the annular web 82 from its dead center position to the position shown in FIG. 6. This overcenter movement is a snap action movement which provides a distinct tactile feedback to the operator of the switch 10 to know that he has moved the switch 10 to its second operative position. The dome 20, due to its resiliency, will return to its normal free state position, as shown in FIG. 1, and return the actuator 24 and key cap 26 to their neutral position, as shown in FIG. 1.

It should be apparent that operation of the rightmost dome 20 would cause actuation of the window either up or down and that depression of the leftmost dome 20 would cause the reverse movement.

From the foregoing, it should be apparent that a novel dual detent dome switch has been provided in which a single dome provides a dual circuit function for energizing a pair of circuits and a third function by returning the rocker actuator to a neutral position. It should be further obvious that the novel dome switch is of a compact and economical construction and its design is such that it provides a distinct tactile feel for each of its two circuit closing operations or functions.

Figure 7:
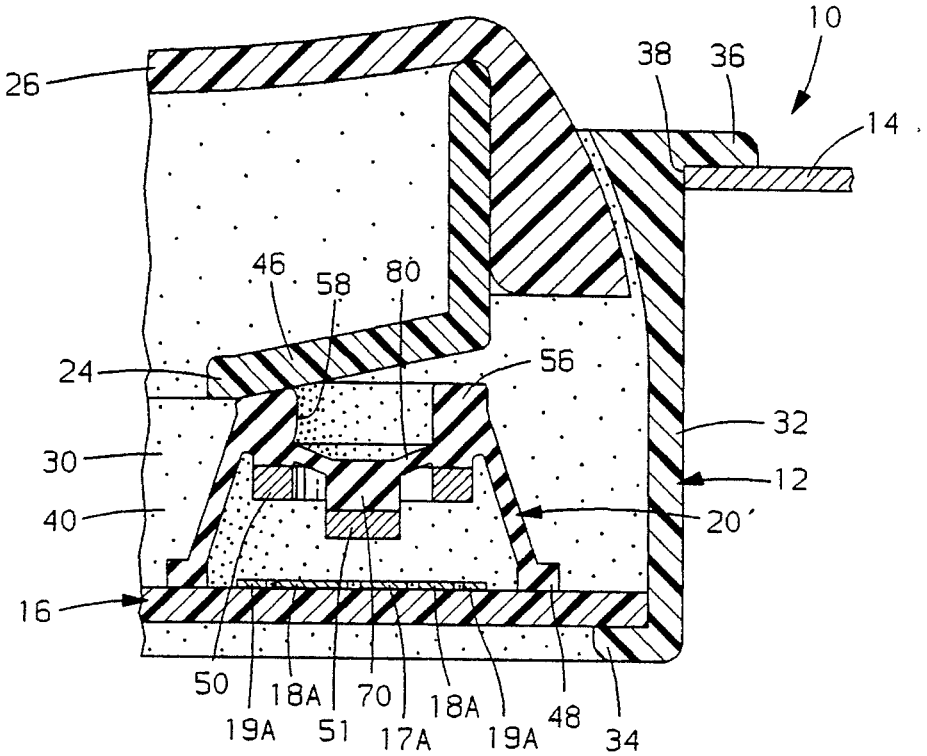
FIG. 7 is a cross sectional view of an alternative embodiment of a dome for the switch assembly of the present invention.

FIG. 7 shows an alternative embodiment for a dome 20' which could be employed in place of the dome 20. The only difference between the dome 20' shown in FIG. 7 is that it is cone shaped, i.e., it has straight sides rather than a curved, bell shaped side. In all other respects, it is of an identical construction and operates in the same manner.

It should be noted that in place of the printed circuit board 16, a planar board having contacts embedded therein which can be connected to conductors could be employed, if desired.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. An electric switch assembly comprising a printed circuit means having circuit traces thereon which terminate in ends closely spaced from each other, an elastomeric dome having an annular base which is mounted on said printed circuit and which overlies said ends of said circuit traces and an actuator for depressing said dome, the elastomeric dome having a resilient annular outer side wall of a given thickness, said side wall at its lower end being integral with said base and at its upper end being integral with an annular ring which carries an electrically conductive element on its underside, a central button carrying an electrically conducting pellet on its underside and a deflectable annular web having an inner end integral with said button and an outer end integral with said ring, said outer end of said web being spaced a greater distance from said printed circuit means than said inner end thereof when the dome is in its normal free state position, said pellet on said button being spaced from said printed circuit means a lesser distance than said element on said ring and said ring and button having thicknesses which are substantially greater than the thicknesses of said side wall and web, said side wall deflecting outwardly when said ring of said dome is being depressed by said actuator to move said pellet into engagement with certain of said ends of said circuit traces and said side wall and said web both being deflectable upon further depression of said ring and with the web moving from its free state position over dead center with a snap action feel to a position in which its outer end is spaced a lesser distance from the printed circuit means than its inner end and until the conductive element is engaged with the ends of said circuit traces on said printed circuit means, wherein said ends of said circuit traces are undulated and closely spaced, but interdigitated with one another.

2. An electric switch assembly as defined in claim 1 and wherein said element carried by said ring is crescent shaped and wherein one of said traces is adapted to be connected to a ground and has a first end portion interdigitated with an end of a second trace and a second crescent shaped end portion surrounding said first end portion and which is undulated and interdigitated with undulations on a crescent shaped end of a third trace.

3. An electric switch assembly comprising a switch housing having printed circuit means having circuit traces thereon which terminate in ends closely spaced from each other at its bottom, a pair of spaced elastomeric domes whose bases are mounted on said printed circuit means and which overlie said ends of said circuit traces and a rocker actuator for depressing said domes, said rocker being supported for pivotal movement by said switch housing and having ends overlying said domes, each of the elastomeric domes having a resilient annular outer side wall of a given thickness, said side wall at its lower end being integral with said base and at its upper end being integral with an annular ring which carries an electrically conductive element on its underside, a central button carrying an electrically conducting pellet on its underside and a deflectable annular web having an inner end integral with said button and an outer end integral with said ring, said outer end of said web being spaced a greater distance from said printed circuit means than said inner end thereof when the dome is in its normal free state position, said pellet on said button being spaced from said printed circuit means a lesser distance than said element on said ring and said ring and button having thicknesses which are substantially greater than the thicknesses of said side wall and web, said side wall deflecting outwardly when said ring of said dome is being depressed by said actuator to move said pellet into engagement with certain of said ends of said circuit traces and said side wall and said web both being deflectable upon further depression of said ring and with the web moving from its free state position over dead center with a snap action feel to a position in which its outer end is spaced a lesser distance from the printed circuit means than its inner end and until the conductive element is engaged with the ends of said circuit traces on said printed circuit means, wherein said annular ring includes an upper annular portion which extends above said upper end of said outer side wall and engages one end of the rocker actuator and, wherein said pellet when said dome is depressed by said actuator is adapted to cause energization of an electric motor at one speed and when said element is further depressed, it is adapted to cause energization of the same motor at a higher speed and, wherein said pellet engages a first end and a ground end of circuit traces on said printed circuit means and said element is circular and bridges a second end and said ground end of circuit traces on said printed circuit means.

* * * * *